United States Patent [19]

Habler

[11] 4,055,283

[45] Oct. 25, 1977

[54] HOLDER FOR A SMOKING-PIPE

[76] Inventor: Adam L. Habler, 4851 Gandy Blvd. 15-2nd, Tampa, Fla. 33611

[21] Appl. No.: 576,707

[22] Filed: May 12, 1975

[51] Int. Cl.[2] ..... A45C 11/00

[52] U.S. Cl. ..... 224/5 R; 131/260; 206/5; 206/244; 206/266; 224/26 R

[58] Field of Search ..... 224/5 R, 26 R, 29 G; 206/5, 242, 244, 265, 266; 150/10; 131/257, 260

[56] References Cited

U.S. PATENT DOCUMENTS

| | | | |
|---|---|---|---|
| 1,133,831 | 3/1915 | Willoughby | 150/10 X |
| 1,934,115 | 11/1933 | Burns | 206/244 |
| 1,966,019 | 7/1934 | Mishey | 224/5 R X |
| 2,028,309 | 1/1936 | Adams | 150/10 |
| 2,283,624 | 5/1942 | Copell | 206/244 |
| 2,604,981 | 7/1952 | Weinstock | 206/244 |
| 2,650,700 | 9/1953 | Wolf | 206/5 R |
| 2,784,887 | 3/1957 | Habler | 131/260 X |
| 2,881,492 | 4/1959 | Aspes | 131/260 X |
| 3,297,217 | 1/1967 | Nichols | 224/5 R |
| 3,938,655 | 2/1976 | Romolt | 206/5 R |

FOREIGN PATENT DOCUMENTS

| | | | |
|---|---|---|---|
| 2,969 of | 1887 | United Kingdom | 206/244 |

*Primary Examiner*—Robert J. Spar
*Assistant Examiner*—Winston H. Douglas
*Attorney, Agent, or Firm*—Paul R. Audet

[57] ABSTRACT

A holder for a smoking-pipe in the form of a substantially rigid or flexible sheath attachable to a support, the sheath having front and back walls defining a cavity and being sufficiently close to one another and sufficiently taut laterally and transversely that they frictionally pinch-hold a pipe stem in the cavity. An interior wall surface can have a high friction surface area, and the sheath can include tautening means to tauten the walls, to increase the frictional hold of the pipe stem.

7 Claims, 12 Drawing Figures

HOLDER FOR A SMOKING-PIPE

BACKGROUND OF THE INVENTION

This invention relates to holders for smoking-pipes.

An object of this invention is to provide a holder for a smoking-pipe, which can be fastened to the edge of a garment pocket and which will retain a pipe firmly in the holder even when the garment wearer bends over from an upright position and the holder is pointed downward.

Another object of this invention is to provide a smoking-pipe holder in the form of a sheath having walls which define a cavity for receiving a pipe stem, wherein the walls are sufficiently close to one another and sufficiently taut laterally and transversely that they frictionally pinch-hold a pipe stem firmly in the cavity.

Another object of this invention is to provide the aforementioned holder which can be substantially rigid or flexible.

Another object of this invention is to provide an aforementioned holder wherein the interior of the sheath walls have high-friction surface areas which aid in frictionally pinch-holding a pipe stem firmly in the cavity.

Another object of this invention is to provide an aforementioned holder wherein a flexible hood is removably connected to the sheath, and is conformable to substantially the shape of, and re-extensible and reclosable over, the pipe bowl, to cover and protect the pipe bowl and to help prevent the pipe from being dislodged from the holder.

Another object of herein is to provide an aforementioned holder with a removably-connected substantially rigid hood for the aforementioned purposes.

Still another object of this invention is to provide a flexible smoking-pipe holder wherein the sheath is flexible and the holder includes tautening means for tautening the sheath walls to increase their frictional pinch-hold on a pipe stem inserted in the cavity.

Yet another object of this invention is to provide an aforementioned smoking-pipe holder wherein a sheath wall top edge portion has an axial bowl-accomodating cutaway therein for accomodating and seating a portion of a pipe bowl, to allow the pipe stem to be inserted more fully within the cavity than if the cutaway did not exist.

These and other objects of the invention will be apparent as it is better understood from the description which follows, which, taken in conjunction with the drawings, discloses preferred embodiments thereof.

DETAILED DESCRIPTION OF THE INVENTION

Figure 1:
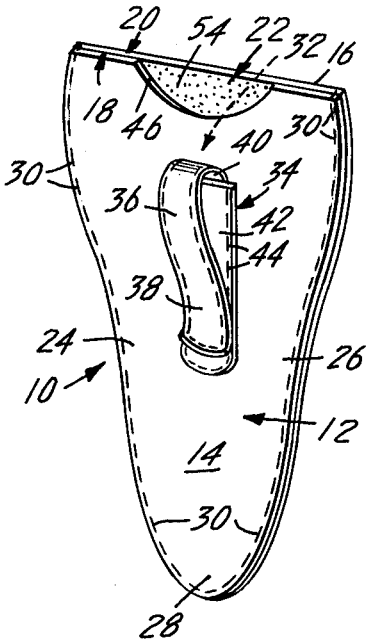
FIG. 1 is an elevational perspective view of one embodiment of the holder for a smoking-pipe of this invention.

Referring to the drawings in detail, FIG. 1 shows a preferred embodiment of the holder for a smoking-pipe, or smoking-pipe holder, of this invention. More particularly, FIG. 1 shows a smoking-pipe holder generally designated 10, for holding a smoking-pipe generally designated P (FIG. 2), having a bowl B and a substantially straight stem S (dashed line) which terminates at bit 11. The smoking-pipe holder 10 of FIG. 1 is comprised of a substantially flat substantially rigid sheath 12 having front and back walls 14, 16, in opposed, roughly or substantially parallel relationship and having respective top edges 18, 20, unconnected along substantially the entirety of their lengths and defining a mouth 22, longitudinal side edge portions 24, 26, and bottom edge portion 28. Side edge portions 24, 26 are joined or connected by suitable means such as stitching 30, and they adjoin bottom edge portion 28. Side and bottom edge portions 24, 26 and 28, in combination with walls 14, 16 and top edges 18, 20, define a cavity generally designated 32 (dashed line), for receiving substantially straight pipe stem S. Substantially straight pipe stems are defined to include stems having moderate curves which do not preclude the stem from being inserted and withdrawn from cavity 32.

As shown in FIG. 1, each wall 14 and 16 is of a single material thickness and sufficiently close to each other and sufficiently taut laterally from side edge portion to side edge portion and translaterally or transversely from wall to wall, that when pipe stem S is inserted through mouth 22 substantially fully into cavity 32 in a manner that the pipe bit is substantially parallel to the front and back walls, the interior surfaces of the walls engage and frictionally pinch-hold the upper and lower surfaces U, L of the pipe stem sufficiently firmly, that pipe stem S is firmly retained in sheath cavity 32 when sheath mouth 22 is pointed downward, as when garment wearer standing or sitting upright bends over to remove something from a floor.

Figure 2:
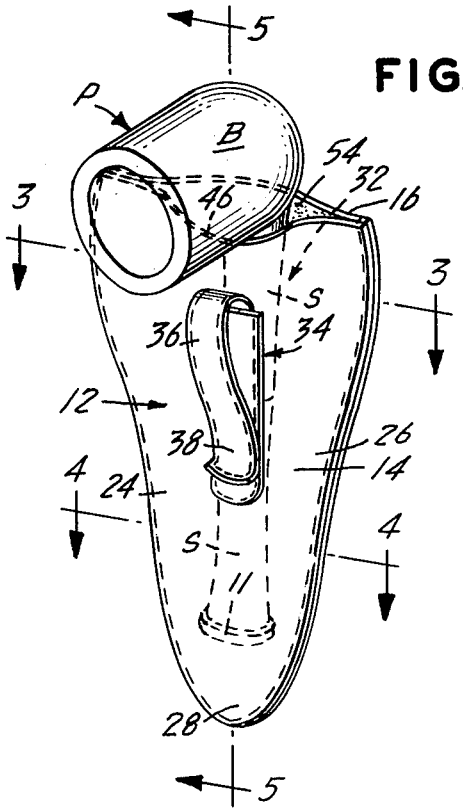
FIG. 2 is an elevational perspective view showing the stem of a smoking-pipe in a holder similar to that shown in FIG. 1.

As shown in FIGS. 1 and 2, the top edge of one of the walls, preferably 14, includes an axial bowl-accomodating cutaway 46, for accomodating and seating therein, an outer surface portion of bowl B that is adjacent the junction of bowl B and stem S. Cutaway 46 allows stem S to be seated more deeply within cavity 32 than if a wall top edge did not include cutaway 46. The shape of the cutaway need not be arcuate as shown but can be of any contour which generally corresponds to the contour of the pipe bowl accomodated.

Sheath 12 also includes suitable fastening means, for example that is generally designated 34, here shown to include an upside down substantially U-shaped spring wire clip 36 whose free leg 38 can be attached or fastened to a suitable support, such as a garment pocket or belt (not shown), and whose rear captive leg 40 is attached to sheath 12 by piece 42, in turn connected or fastened to the outer surface of a wall, preferably 14, by suitable means such as stitching 44. Fastening means 34 allows sheath 12 to be fastened to a support in a manner that pipe stem S, its bit 11, and sheath bottom edge portion 28 normally point downward, that is, in the direction of the force of gravity.

FIG. 2 shows that the interior surface of wall 16 preferably has a pipe stem-retaining high friction surface area 54 which provides relatively greater frictional pinch-hold of stem S than if the surface area was not present. The preferred high friction surface area or areas can be provided on walls 14 and/or 16 by natural, specially finished interior surfaces of the sheath wall material. Examples of materials which provide a high-friction surface area are natural or roughly finished leathers, rubbers, sponge-rubbers, plastics including vinyls, foamed rubbers and foamed plastics, and other suitable materials.

Figure 3:
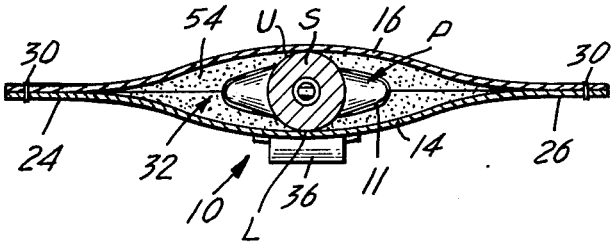
FIG. 3 is a top cross-sectional view taken along line 3—3 of FIG. 2.
Figure 4:
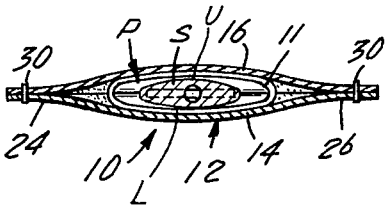
FIG. 4 is a top cross-sectional view taken along line 4—4 of FIG. 2.
Figure 5:
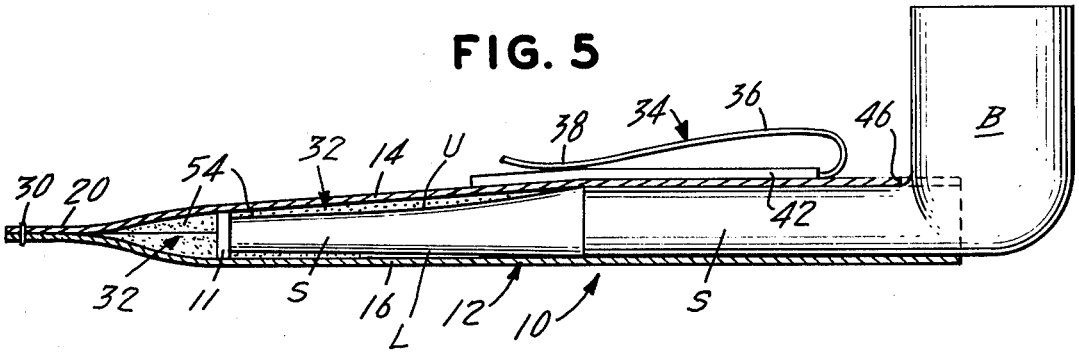
FIG. 5 is a side cross-sectional view taken substantially along line 5—5 of FIG. 2.

FIGS. 3, 4 and 5 are cross-sectional views taken respectively along lines 3—3, 4—4 and 5—5 of FIG. 2, through respective upper, lower and full length portions of sheath 12 and stem S. FIGS. 3-5 shown the close spatial relationship of walls 14, 16 and how their closeness and tightness transversely from wall to wall, and laterally from side edge portion 24 to side edge portion 26, exert pinch-holding force upon diametrically opposed portions of stem S and its bit 11, to firmly hold or retain stem S and pipe P in holder 10, even if the holder is upended.

Figure 6:
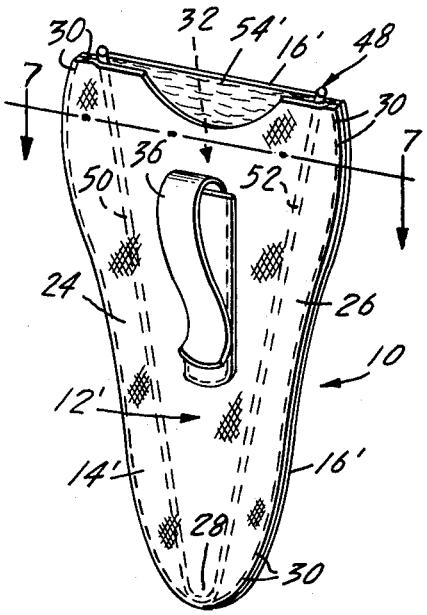
FIG. 6 is an elevational perspective view of another embodiment of the smoking-pipe holder of this invention.

FIG. 6 shows another embodiment of smoking-pipe holder 10, wherein front and back walls 14', 16' of sheath 12' are flexible, and the holder 10 includes tautening means for tautening flexible walls 14', 16' to increase their frictional pinch-holding force on a pipe stem S held in the holder, over the force that would be exerted by the flexible walls without the tautening means. The tautening means can be any suitable means such as rubber or elastic on or in the wall material, or external or internal of the sheath. FIG. 6 shows tautening means in the form of substantially V-shaped metal spring wire 48 for exerting lateral tension against side edge portions 24, 26. The lateral tension which forces walls 14', 16' transversely or translaterally closer together, is exerted by spring wire elongated side extensions 50, 52, portions of, or the major lengths of which are seated in the cavity 32 substantially along side and bottom edge portions 24, 26 and 28. Since portions of each side extensions 50, 52 in their unseated, unbiased, natural positions, are laterally further apart from each other than the respective wall edge portions are from each other, when spring wire 48 is seated in the sheath cavity, the physical limitations of side wall stitching 30 maintain side extensions 50, 52 in a position laterally inward toward each other and the tension in spring wire 48 biases the side extensions laterally outward against stitching 30 and thereby keeps the walls taut and transaxially close to each other to increase the wall pinch-hold on a pipe stem in the sheath cavity. Although tautening means, for example spring wire 48, can be employed with or in relation to substantially rigid sheaths 12 of FIGS. 1-5, it is especially advantageous to employ such tautening means such as spring wire 48 with sheaths such as 12' which are flexible to the degree or extent that their construction and/or the inherent, or given rigidity or flexibility of their wall material do not by themselves provide sufficient wall pinch-holding force upon stem S to hold pipe P in the holder. FIG. 6 also shows that the interior surface of back wall 16' has a high friction surface area 54' thereon.

Figure 7:
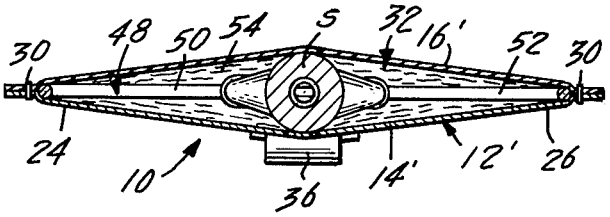
FIG. 7 is a top cross-sectional view as would be taken along line 7—7 through a pipe stem seated in the holder of FIG. 6.

FIG. 7 is a cross-sectional view as would be taken along line 7—7 through pipe stem S if it were seated in holder 10 of FIG. 6. More particularly, FIG. 7 shows extensions 50, 52 of spring wire 48 exerting lateral forces in opposite directions against stitching 30 of side edge portions 24, 26 to create a greater translateral or transverse wall frictional pinch-hold on diametrically opposed circumferential portions of pipe stem S than if spring wire 48 was not within holder 10. FIG. 7 shows that high friction surface area 54 can be provided by an uneven or rough finish on the interior surface of the material of which wall 16' is made.

Figure 8:
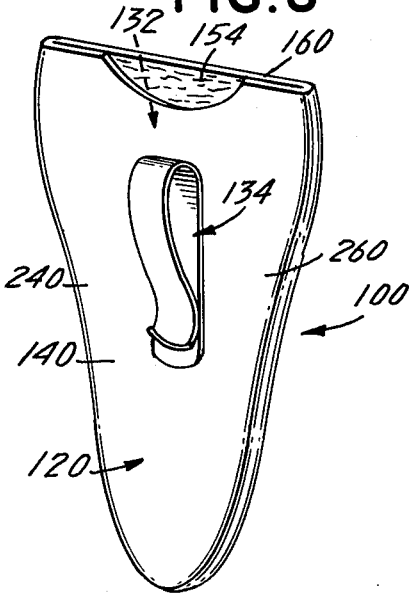
FIG. 8 is an elevational perspective view of another embodiment of the smoking-pipe holder of this invention.

FIG. 8, an elevational perspective view of another embodiment of the holder of this invention, shows a holder 100 very similar to the holder shown in FIGS. 1-7 except that its sheath 120 is integral or one piece. Thus, side edge portions 240, 260 are integral. One-piece holder 100 can be molded or formed of any suitable moldable material such as natural or synthetic rubbers, or plastics such as vinyls or polyethylenes. Preferably, holder 100 includes a high-friction surface area 154 such as a rubber or foamed polystyrene lining adhered, bonded or otherwise affixed to portions or the entirety of one or both of the interior surfaces of walls 140, 160. Sheath 120, like sheath 12 (FIGS. 1-5), can be substantially rigid, i.e. it can have some tolerable flexibility so long as it inherently, or by construction, or both, provides the requisite sufficient pinch-holding force of pipe stem S As previously explained, if the sheath is too flexible to hold a pipe within its cavity 132 when the sheath is upended, tautening means such as spring wire 48 can be employed to provide any additional frictional pinch-holding force needed. Fastening means 134 preferably is one-piece and bonded or sealed to holder 100.

Figure 9:
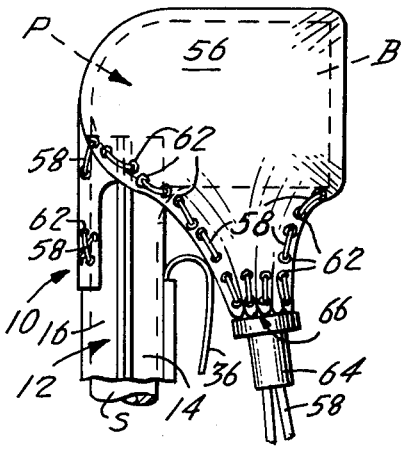
FIG. 9 is a partial side elevation of the upper portion of the smoking-pipe holder of this invention having a flexible hood drawn about and enclosing the bowl of a pipe carried in the holder.

FIG. 9, a partial side elevation of an upper portion of a smoking-pipe holder of this invention, shows that holder 10 (or 100) preferably includes as an individual element a flexible hood 56, preferably made of leather, having means such as lacing 58, or snap 60 (FIGS. 10, 11 and 12), for removably connecting hood 56 to sheath 12. Hood 56 also includes means for drawing it about the pipe bowl. The drawing means can be any suitable means such as provided by elastic, or a separate cord, or an extension of lacing 58 extended through openings 62 along the hood edge. Lacing 58 acts as a drawstring with slide 64 to allow hood 56 to be drawn and puckered about pipe bowl B. Hood 56 protects and polishes the bowl, and, in cooperation with walls 14, 16 helps retain stem S in the sheath cavity when the sheath mouth is pointed downward. Hood 56 has a large opening 66 which, although shown drawn closed by slide 64, allows the hood to be undrawn and lifted over the pipe bowl to free pipe P for removal from holder 10.

Figure 10:
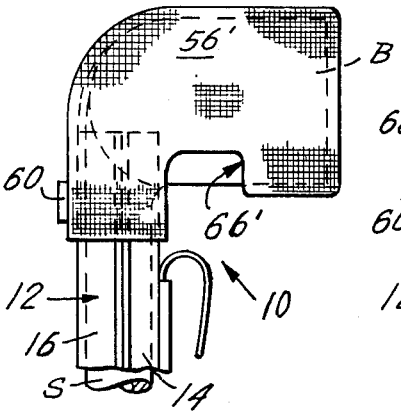
FIG. 10 is a partial side elevation of the upper portion of a smoking-pipe holder of this invention, showing another embodiment of the flexible hood of this invention.

FIG. 10 shows another hood 56', this one made of a stretchable material which can have an opening 66' of any suitable size for passing the hood over pipe bowl B while the hood is unconnected or removably connected to sheath 12, for example by snap 60.

Figure 11:
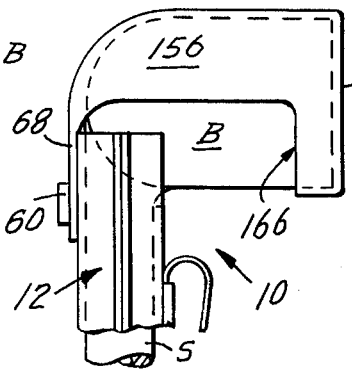
FIG. 11 is a partial side elevation of the upper portion of a smoking-pipe holder of this invention, showing a substantially rigid version of the hood of this invention.
Figure 12:
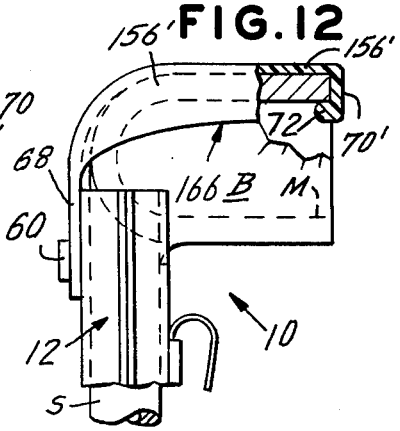
FIG. 12 is a partial side elevation with portions broken away, of the upper portion of a smoking-pipe holder of this invention, showing another substantially rigid version of the hood of this invention.

FIGS. 11 and 12 show alternative embodiments of hoods 56 and 56'. More particularly, FIG. 11 shows a substantially rigid hood 156 preferably made of plastic and having a face 70 which extends over and encompasses the entire pipe bowl lip to help keep stem S within the sheath cavity when the holder is upended. Hood 156 has a large opening 166 for passing hood 156 over bowl B while the hood is not attached to sheath 12 by snap 60. Once it is so attached, the hood can be removed by unsnapping snap 60, lifting the hood back portion 68 and slipping hood 156 and its face 70 forward, axially away from the pipe bowl mouth. When hood 156 is made of a material having little flexibility, it is advantageous that the hood back portion 68 be made of slightly flexible, extensible or stretchable material such as a strap, or that the hood be slightly oversized relative to the pipe bowl to provide a gap between the bowl and hood, to facilitate hood removal while the hood is fastened to sheath 12 by snap 60.

FIG. 12 shows another substantially rigid hood 156', this one having a modified face 70' that is shorter than face 70 and extends over and emcompasses only a portion of the circumference of the lip of pipe bowl B. Face 70' has a bead 72 which projects a sufficient distance into pipe bowl mouth M and engages the pipe bowl lip to thereby steady the pipe, positively hold it in place and help keep its stem deeply within the holder cavity. Bead 72 and slightly larger mouth 166, render 156' easy to place over and remove from pipe bowl B. Hoods 56', 156 and 156' of FIGS. 10, 11 and 12 are advantageous in that they do not require additional drawing means such as lacing 58 or slide 64 to extend the hoods over, or remove them from pipe bowl B.

As shown in the drawings, sheath 12 of the holder of this invention can be substantially rigid or flexible, it can be one-piece, or it can have separate walls connected to each other along their side and bottom edge portions, so long as the sheath and its walls, inherently or by means of suitable lining, patching or tautening means, provide sufficient frictional pinch-holding force to frictionally pinch-hold and retain in the sheath when it is upended, a pipe whose stem has been inserted into the sheath cavity. For purposes of this invention, substantially rigid means the sheath is rigid enough to maintain its sheath shape, provide the aforementioned requisite sufficient pinch-holding force, yet have tolerable, i.e. enough, "give" or flexibility to allow insertion and withdrawal of a pipe stem from the sheath cavity. For purposes of this invention, a sheath that is flexible is incapable, without tautening means, of providing requisite frictional pinch-holding force.

The holder for a smoking-pipe of this invention can be made of any suitable material or combination of materials. Suitable substantially rigid materials include leathers, and moldable materials selected from the group consisting of rubbers, and plastics, including vinyls and polyethylenes. Suitable flexible materials include materials of which human stockings are made, rubbers, plastics including vinyls and polyethylenes, leathers and imitations thereof. Examples of materials of which human stockings are made are variously weaved stretchable or unstretchable natural or synthetic fabrics such as silks, satins, nylons, rayons, cottons, wools and orlons.

Hoods 56 and 56' can be made of any flexible material that is conformable to substantially the shape of pipe bowl B and is re-extendible and reclosable thereover. Hoods 56 and 56' are made of a material selected from the group consisting of the previously defined materials of which human stockings are made, and rubbers, plastics including vinyls and polyethylenes, leathers, and imitations thereof. Hoods 156 and 156' shown in FIGS. 11 and 12 are substantially rigid, which means that they have tolerable, i.e., enough, "give" or flexibility to allow them to be easily closed over and removed from pipe bowls B. Hoods 156 and 156' can be made of any suitable materials such as leathers, moldable materials such as plastics, vinyls and rubbers. The hood materials can be of any color. Advantageously, the colors are selected to match those of the garments to which the holders are secured. The interior surfaces of the hoods desireably have a polishing effect on pipe bowls. As shown in the drawings, hoods 56, 56' and 156 and 156' are reclosable directly over at least a portion of the pipe bowl, which portion is other than the bowl mouth.

It is thought that the invention and many of its attendant advantages will be understood from the foregoing description and it will be apparent that various changes may be made in the form, construction and arrangement of the parts without departing from the spirit and scope of the invention or sacrificing all of its material advantages, the forms hereinbefore described being merely preferred embodiments thereof.

I claim:

1. A holder for smoking-pipe having a substantially straight stem and a bowl, comprising:

a substantially flat, substantially rigid sheath having a. substantially rigid front and back walls each of a single material thickness, in opposed, substantially parallel relationship, the interior surface of one of said walls having a high friction surface area, said walls having top edges unconnected along substantially the entirety of their lengths and which define a mouth, longitudinal side edge portions, and a bottom edge portion, said side edge portions adjoining said bottom edge portion, and said portions in combination with said walls and said top edges, defining a cavity for receiving a substantially straight pipe stem, and b. fastening means connected to the outer surface of one of the walls, for fastening the holder to a support in a manner that the pipe stem normally points downward toward the sheath bottom edge, the walls being sufficiently close spatially to each other and sufficiently taut laterally from side edge portion to side edge portion and transversely from wall to wall, that when the pipe stem is inserted through the mouth substantially fully into a cavity in a manner that the pipe bit is substantially parallel to the front and back walls, the interior surfaces of the walls, including the high friction surface area, engage and frictionally pinch-hold the upper and lower surfaces of the pipe stem sufficiently firmly that the pipe stem is firmly retained in the cavity even when the sheath is pointed downward, and, c. as an individual element, a flexible hood removably connected to the sheath, adapted to be conformed to substantially the shape of the pipe bowl, the sheath and the hood having means for removably connecting the hood to the sheath, and the hood providing protection for the bowl and cooperating with the walls in retaining the stem in the cavity when the sheath mouth is pointed downward.

2. The holder of claim 1 wherein the material of which the hood is made is selected from the group consisting of the materials of which human stockings are made, rubbers, plastics, leathers and imitation leathers.

3. The holder of claim 1 wherein the flexible hood includes means for drawing it about the pipe bowl.

4. The holder of claim 1 wherein one of the sheath top edges includes a bowl-accomodating axial cutaway for accomodating and seating a portion of the pipe bowl therein, to allow the pipe stem to be inserted more deeply within the cavity than if the sheath top edge did not include said cutaway.

5. The holder of claim 1 wherein the flexible hood is made of stretchable material and is re-extendible and reclosable over the pipe bowl

6. The holder of claim 5 wherein the stretchable material of which the hood is made is selected from the group consisting of the materials of which human stockings are made, rubbers, plastics, leathers, and imitation leathers.

7. The holder of claim 5 wherein the flexible hood includes means for drawing it about the pipe bowl.

* * * * *